US006053357A

United States Patent [19]

Yoh

[11] Patent Number: 6,053,357

[45] Date of Patent: Apr. 25, 2000

[54] POP-UP TISSUE AND SHEET DISPENSER

[75] Inventor: Julie Yoh, Medford, N.J.

[73] Assignee: Irving Tissue Inc., Philadelphia, Pa.

[21] Appl. No.: 08/946,871

[22] Filed: Oct. 8, 1997

[51] Int. Cl.[7] ..... B65H 1/00

[52] U.S. Cl. ..... 221/63; 206/494

[58] Field of Search ..... 221/45, 48, 63, 221/33; 206/409, 494, 812

[56] References Cited

U.S. PATENT DOCUMENTS

| | | | |
|---|---|---|---|
| 2,849,152 | 8/1958 | Tuttle | 221/48 |
| 3,036,729 | 5/1962 | Asman | 221/48 |
| 3,083,866 | 4/1963 | Strange | 221/48 |
| 3,239,097 | 3/1966 | Bates et al. | 221/48 |
| 3,369,699 | 2/1968 | Enloe et al. | 221/48 |
| 3,979,019 | 9/1976 | Bliss | 221/48 |
| 4,200,200 | 4/1980 | Hein et al. | 221/48 |
| 4,231,491 | 11/1980 | Pierson et al. | 221/48 |
| 4,356,950 | 11/1982 | Benham | 229/11 |
| 4,411,374 | 10/1983 | Hotchkiss | 221/63 |
| 4,513,862 | 4/1985 | Mallow | 206/233 |
| 4,574,952 | 3/1986 | Masui | 206/494 |
| 4,678,099 | 7/1987 | Matsui | 221/48 |
| 4,681,240 | 7/1987 | Wyant | 221/48 |
| 4,765,508 | 8/1988 | Poppe | 221/48 |
| 4,768,679 | 9/1988 | Matsui | 221/48 |
| 4,785,970 | 11/1988 | Engelmayer | 221/47 |
| 4,863,064 | 9/1989 | Dailey, III | 221/48 |
| 4,877,154 | 10/1989 | Matsui | 221/48 |
| 5,129,545 | 7/1992 | Parks | 221/34 |
| 5,219,421 | 6/1993 | Tipping | 221/63 |
| 5,316,177 | 5/1994 | Boldt | 221/63 |
| 5,415,320 | 5/1995 | North et al. | 221/63 |
| 5,520,308 | 5/1996 | Berg, Jr. et al. | 221/50 |
| 5,535,887 | 7/1996 | Young et al. | 206/494 |
| 5,542,598 | 8/1996 | Capo | 229/242 |

FOREIGN PATENT DOCUMENTS

| | | | |
|---|---|---|---|
| 793745 | 4/1958 | United Kingdom | 221/63 |

*Primary Examiner*—Kenneth W. Noland
*Attorney, Agent, or Firm*—Dewey Ballintine LLP

[57] ABSTRACT

An upright, or "pop-up", box dispenser having a curvilinear opening for dispensing thin sheets of paper such as tissues or non-woven products. The curvilinear opening may be in the shape of an "S", multiple "S" shapes or arcs. Preferably, the effective open area of the curvilinear opening is about 2.5 square inches or less. Typically, the curvilinear opening is incorporated into a thin plastic film overlaid on the top of a cardboard box.

3 Claims, 14 Drawing Sheets

POP-UP TISSUE AND SHEET DISPENSER

FIELD OF THE INVENTION

This invention relates to an improved method of dispensing thin sheets of paper, including facial tissue, and other non-woven products from an upright, or pop-up, box dispenser. The invention allows for interfolded single sheets to be dispensed without tearing, while maintaining these sheets in an aesthetic pop-up presentation and protecting the sheets that remain in the box. Another advantage of the invention is that the user's access to the first sheet is improved while the potential of dispensing more than one sheet at a time is significantly reduced when compared to prior art dispensers.

BACKGROUND OF THE INVENTION

Generally, tissue box dispensers consist of a top wall, four side walls and a bottom wall. There are two basic types of tissue dispensers: the flat carton and the upright carton. In the former type, the tissues are laid out flat on the bottom of the carton and are dispensed through an aperture, opening or slit on the top of the carton or on the top which partially extends down to the side wall. Inside the carton, the tissues may be interfolded or laid on top of one another. In upright cartons, however, the tissues are folded into an inverted "U" -shaped clip, which provides for pop-up dispensing. The aperture or opening for dispensing the tissues is generally in the top of the carton, which also may contain a thin plastic film to hold the popped-up tissue in place, and a slit permitting removal of the tissues.

There are a number of problems associated with withdrawing tissues through apertures in cartons. Tearing of the tissue sheets upon withdrawal from the carton often occurs, especially the first few sheets dispensed, due to frictional forces and pressures of the wall of the carton against the compressed tissues within the inverted U-shaped clip. Such tearing results in a withdrawn tissue that is not aesthetically pleasing and often is unusable. This problem is an even greater concern when the fabric of the tissue is weak.

Another problem with upright cartons is finding a suitable aperture width and shape. In this regard, it is desirable to make the aperture sufficiently wide and/or flexible so that the user is able to insert his or her fingers to access the first tissue, while making the opening narrow enough to maintain the tissue following the withdrawn tissue in a popped-up position. Such a popped-up presentation allows greater ease of access to the tissue sheets following the first dispensed sheet and provides a more aesthetic appearance to the tissue box.

However, most known openings which facilitate access to the first tissue also create the additional problem that more than one tissue sheet is withdrawn at one time. This is especially true when the tissues in the box are interfolded, or when such interfolded sheets are tab-results connected. The withdrawal of more than one sheet at a time results in a waste of tissue sheets, as the user generally does not reinsert the extra tissue sheets back in the box. Additionally, such dispensing creates a perception in the mind of the user that the tissue box operates inefficiently.

A wider opening may permit dust or foreign particles to easily enter the box or settle onto the tissue sheets remaining in the box. Besides creating a pronounced unaesthetic effect, the next to be withdrawn tissue sheet often is rendered useless due to such accumulated dirt or dust.

SUMMARY OF THE INVENTION

It is an object of the invention to provide an improved tissue dispenser having an opening, aperture, or slit on the top of the dispenser which provides improved access to the tissue sheets contained in the dispenser while protecting the sheets from dust or other foreign particles.

It is also an object of the invention to provide a tissue box design which facilitates pressure on the sheets in the box, maintaining them in their intended position while permitting only one sheet to be released from the box at a time.

It is yet another object of the invention to provide a tissue dispenser having an aesthetically pleasing popped-up tissue presentation, hence providing an extra purchasing incentive for the consumer.

These and other objects are achieved by a unique tissue dispenser design having a curvilinear or "S"-shaped opening. In the preferred embodiment, the invention consists of an upright tissue carton containing an inverted "U"-shaped clip of interfolded tissues within the box such that the withdrawal of one tissue forces the next tissue into a popped-up position accessible to the user. The box (or dispenser) can vary in shape, size, and other details, but essentially consists of one top wall, four side walls, and a bottom wall. The top wall can consist of any shape, including square, rectangular or oval, and has an opening overlaid in the form of paper or flexible plastic film which is permanently attached to the top wall. The box has a second opening in the overlaid paper or plastic film, which is curvilinear. The curvilinear opening preferably is "S"-shaped, with either a single "S" or a series of smaller "S" shapes along its axis.

DETAILED DESCRIPTION OF THE INVENTION AND DRAWINGS

Figure 1:
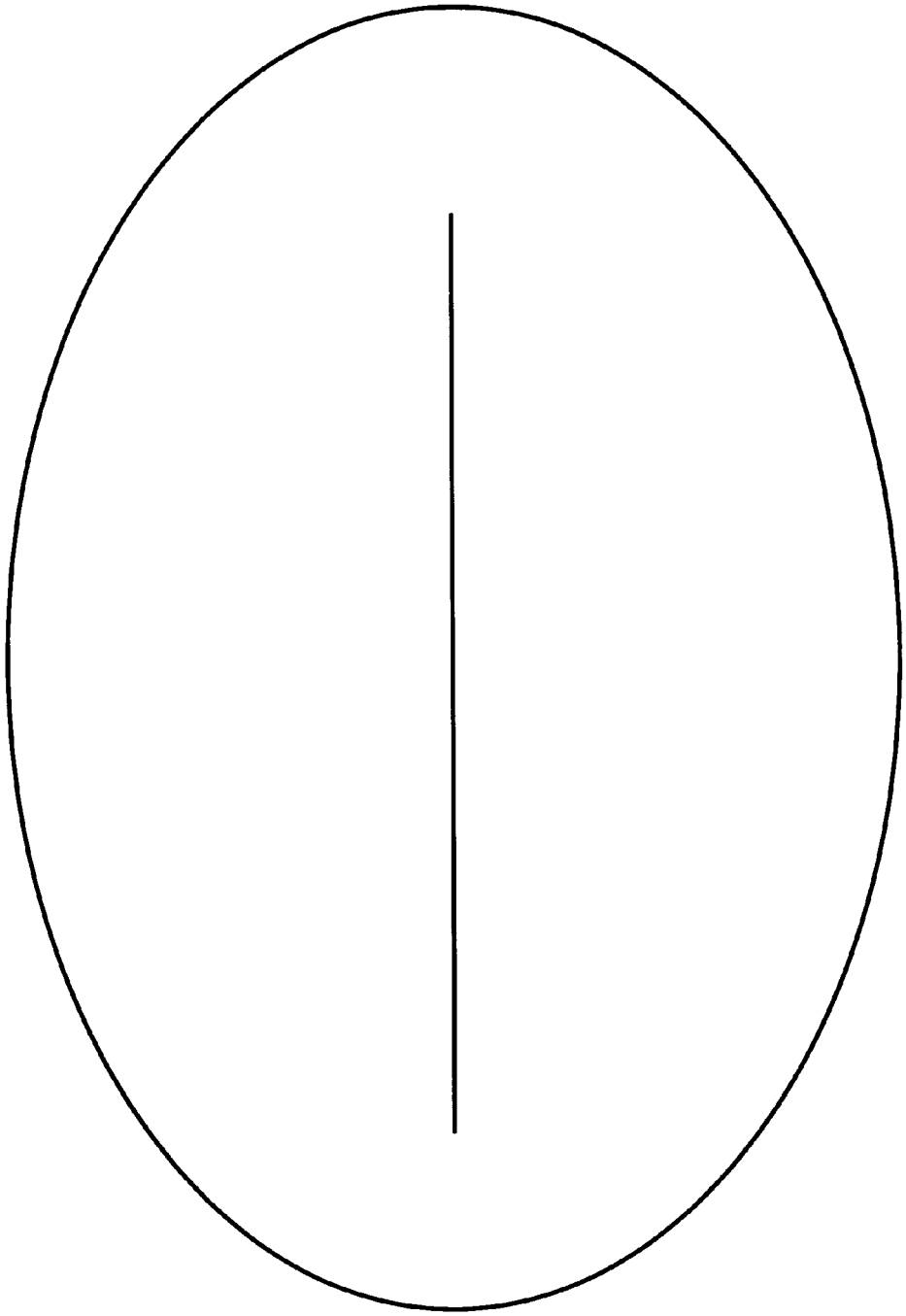
FIG. 1 PRIOR ART
FIG. 1 is a top view of the dispensing wall of a commercially available prior art tissue carton with a single line slit for an opening. The plastic film on top of this wall likewise contains a single opening overlapping the opening in the carton.

The invention describes a tissue sheet dispenser which has a dispensing wall, at least three side walls, and a bottom wall. The dispensing wall contains an "S"-shaped curvilinear opening, preferably an overlaid thin plastic film, which may be attached to the dispensing wall by any suitable adhesive. The adhesive typically is attached to the plastic film along the edges of the top wall of the carton. Inside the dispenser are stacked tissues preferably in the form of an inverted "U"-shaped clip of interfolded tissues. The tissues themselves typically are made of thin sheets of paper, but may be any thin sheet of non-woven material.

During the withdrawal of the tissues, the user pulls the top tissue in the clip, and withdraws it through the opening in the dispensing wall of the carton. Removal of this first tissue sheet causes the next adjacent sheet in the clip to be partially pulled through the opening. This partially-dispensed tissue is held in a popped-up position by the edges of the slit, until it is pulled out by the user.

The opening through which the tissue sheets are removed may be composed of a single "S" or a series of "S" shapes along the axis. The shape of the "S" can be varied in its style with variations in the ratios of the distance between the center of the "S" to the top of the "S" and between the center of the "S" to the side of the "S". Preferably, the radius of the arcs of the "S" shape is between about ½ and ¾ inches. Furthermore, the "S" shape can be shaped with a curved turn or a sharp-pointed turn, and the line that forms the "S" shape can be smooth, waved, or zig-zag. It is also within the scope of the invention that the shape of the opening may be irregular or unsymmetrical. Thus, the invention includes openings formed of two or more line segments, with each intersection being less than about 750°. Openings may also be comprised of at least one line segment and at least one arc; at least one segment of an arc; and multiple "S"-shaped curves, where the arc radius of each of the "S"-shaped curves preferably is about ¼ inches. The opening may also be discontinuous. In its preferred embodiment, the line width of the curvilinear opening may vary, preferably from about 0 to 0.85 inch, and the ends of the dispensing wall or overlaid film forming the opening may overlap. The opening may vary in width along different parts of the "S".

The "effective open area" of the opening on top of the tissue carton is the area available for the tissue sheet to pass through the dispensing wall or overlaid film as it is being pulled out of the box. The effective open area includes the "actual" open area in the dispensing wall or overlaid film as well as open areas created by opening flaps in the dispensing wall or overlaid film which are otherwise closed. The Curvilinear opening in the present invention provides an effective open area of about 2.5 square inches or less for every 3 inches of the dispensing wall or overlaid film opening. Most preferably, the effective open area is between about 1 inch to 2 inches. However, the effective open area may be as large as 3–4 inches depending on the type of tissue used, the particular curvilinear shape employed and the results desired.

The dispensing wall or overlaid film may have varying levels of stiffness, depending on the type of product used and other considerations known to persons skilled in the art, and preferably is sufficiently flexible as to allow tissues to be withdrawn with minimal resistance. Suitable films include polyethylene films having thicknesses of about 10 mil. or less, preferably about 2 mil. or less. Other flexible materials are also suitable for use in the invention, and include paper or thin cardboard, provided that these materials provide minimal resistance as tissues are withdrawn.

Tissues of various materials, weight, and thickness can be used in the dispenser according to the invention. Preferably, however, the tissues contained inside the dispenser are interfolded, two-ply, and have a thickness of about 160/24 ply and weight of about 21 lb./R.

EXAMPLE 1

The curvilinear design of this invention was compared to "X"-shaped and single slit designs of the prior art. Specifically, the designs were tested for the number of sheets torn on first access and the number of sheets following access of a given tissue, known as the number of sheets "tailing" the first sheet dispensed.

In the experiment, 10 cartons, each containing 95 tissues, with different openings were compared by manually removing all the tissues in the box one at a time. The tissues in each carton were removed by a skilled operator, and the amount of force used to remove each tissue was consistent. The tissues in each of the cartons were all interfolded two-ply and were considered "weak" facial tissues. A "weak" tissue is defined as a tissue having a thickness of about 150/24 ply and a weight of about 20 lbs./R., with a total tensile strength of about 16–18 oz./in. A table summarizing the averages of the trial results is set forth below.

TABLE 1

Figure 5:
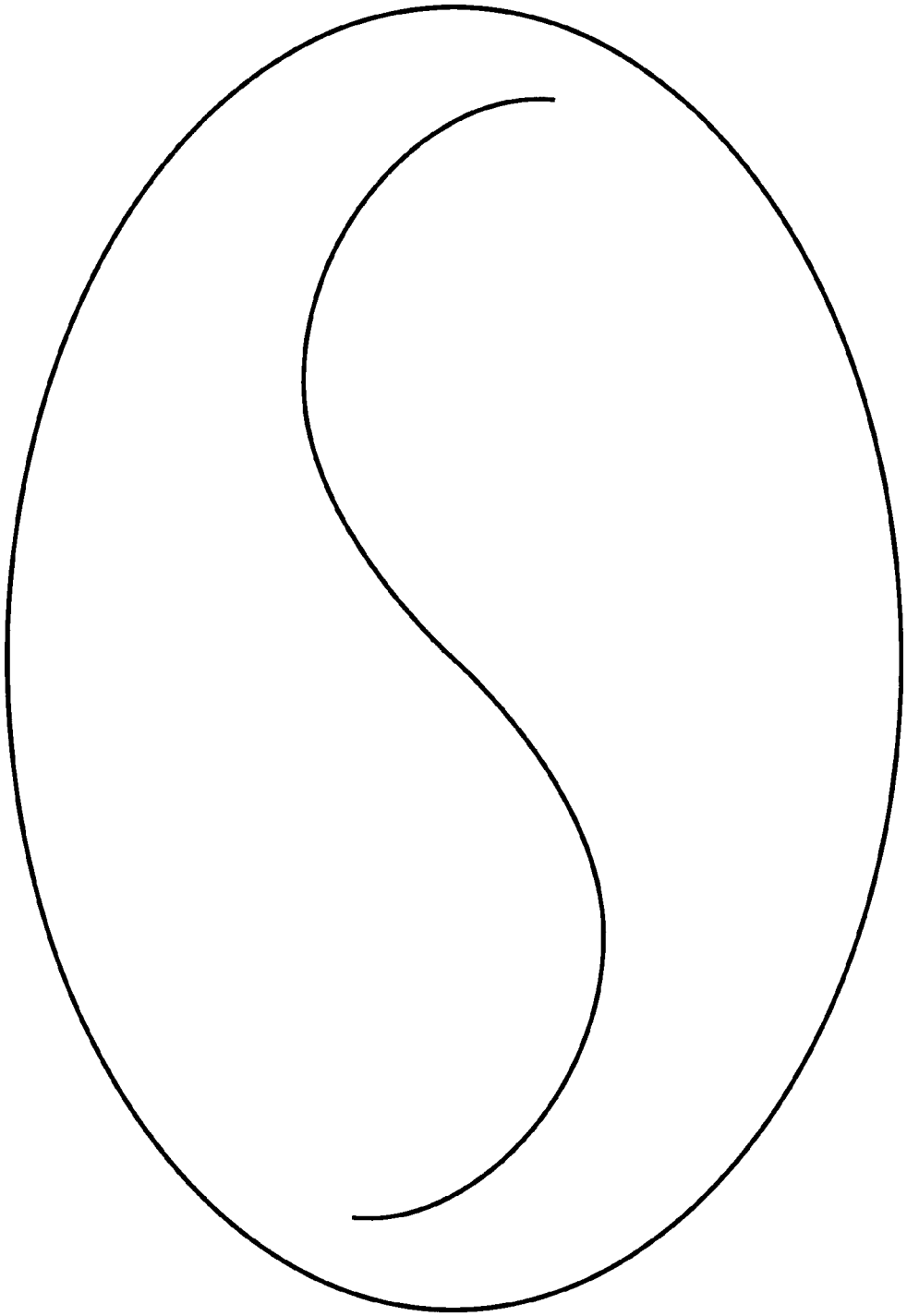
FIG. 5 is a top of view of the dispensing wall of an embodiment of a dispenser in accordance with this invention. The opening is "S"-shaped, where the two arcs of the "S" are elliptically shaped and the radius of one arc of the "S"-shaped curve preferably is about ½ inch by ¾ inch.
Figure 6:
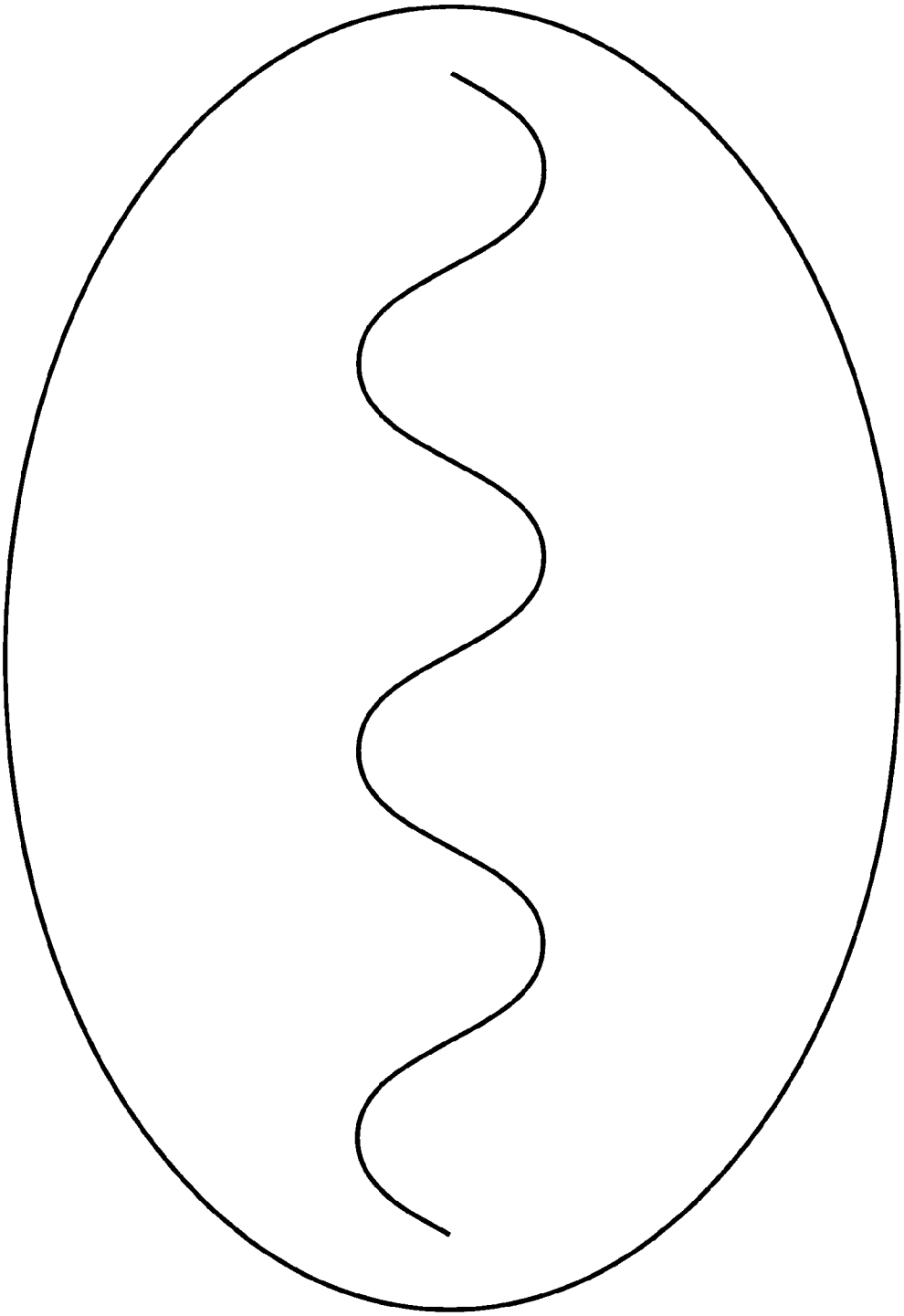
FIG. 6 is a top view of the dispensing wall of another embodiment of a dispenser in accordance with this invention. The opening contains multiple "S"-shaped curves instead of one main "S"-shaped curve. The radius of the arc of each of the "S"-shaped curves preferably is about ¼ inch.
Figure 7:
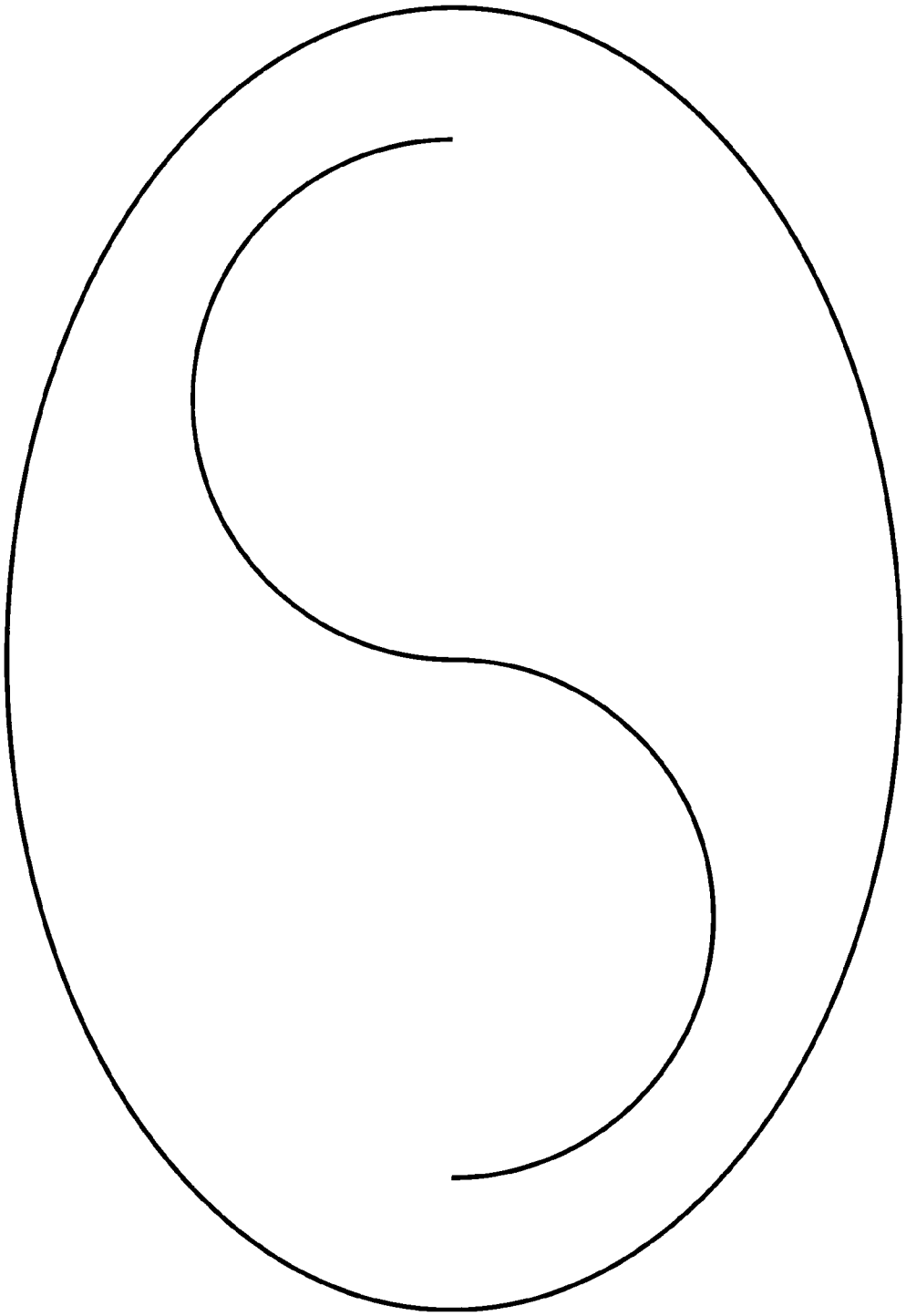
FIG. 7 is a top view of the dispensing wall of another embodiment of a dispenser in accordance with this invention. The opening is "S"-shaped, and the radius of each arc of the "S" preferably is about ¾ inches.
Figure 8:
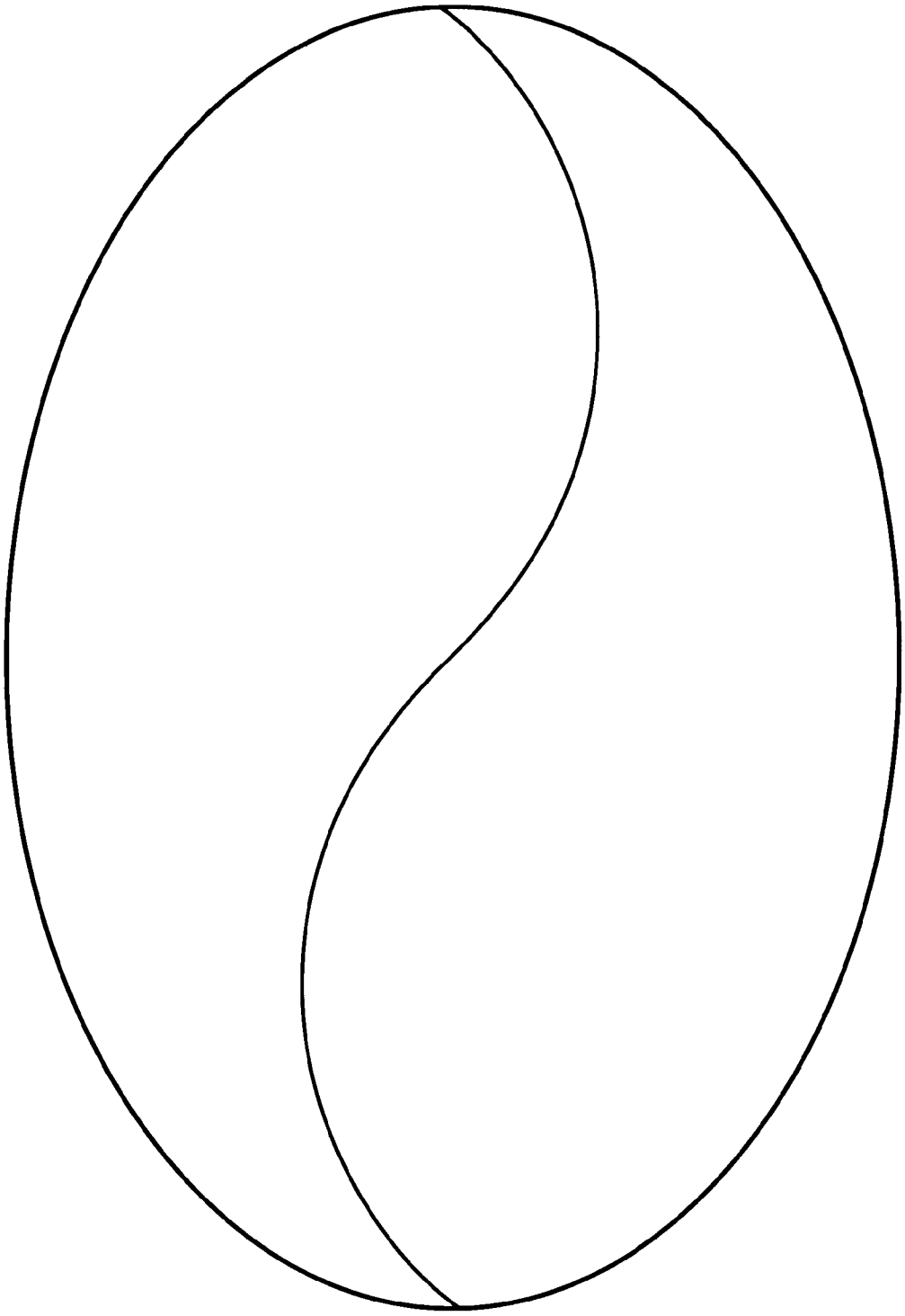
FIG. 8 is a top view of the dispensing wall of another embodiment of a dispenser in accordance with this invention. The opening is a reverse "S" shape.
Figure 9:
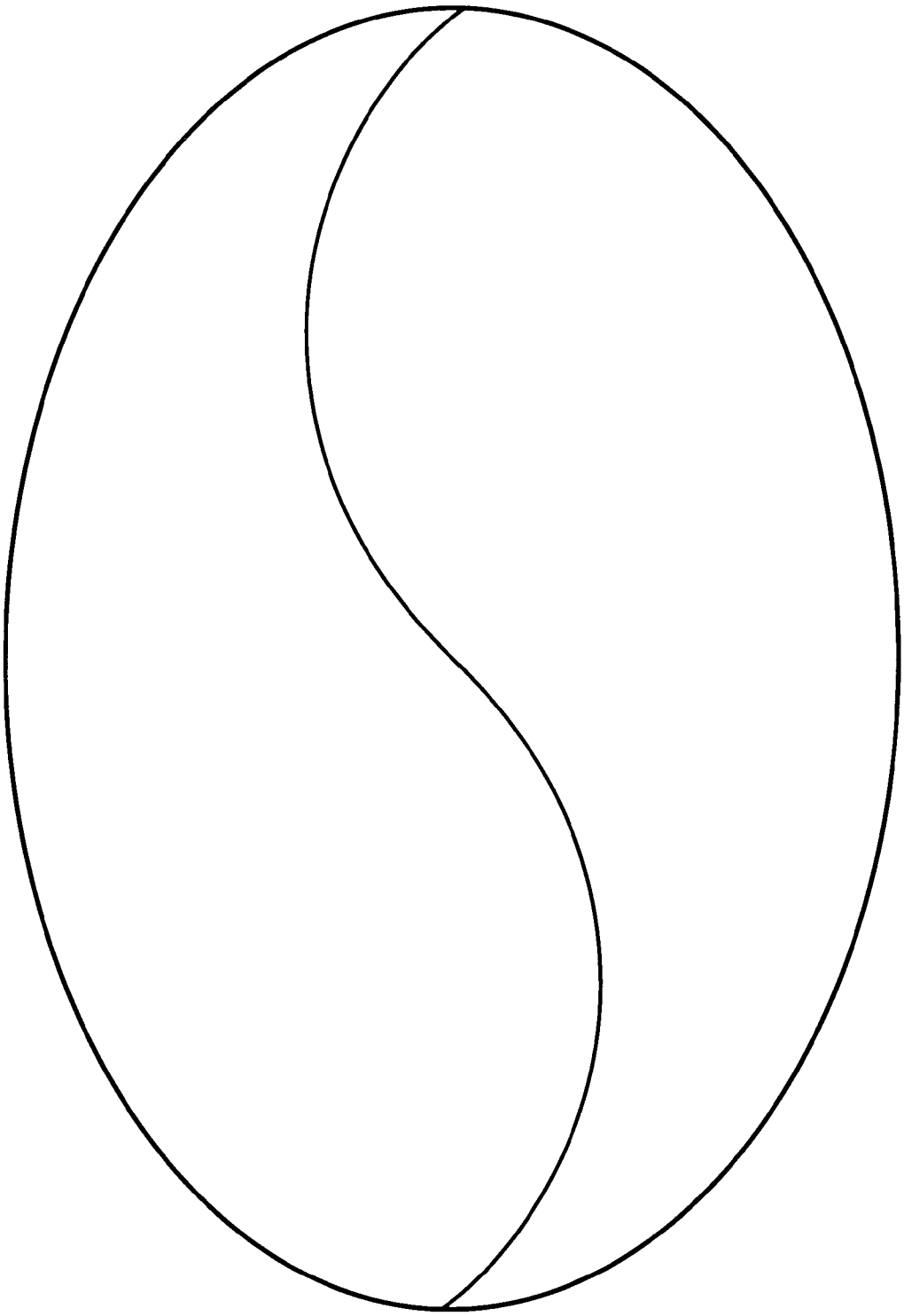
FIG. 9 is a top view of the dispensing wall of another embodiment of a dispenser in accordance with this invention. The opening is an "S" shape where the upper and lower arcs are asymmetrical.
Figure 10:
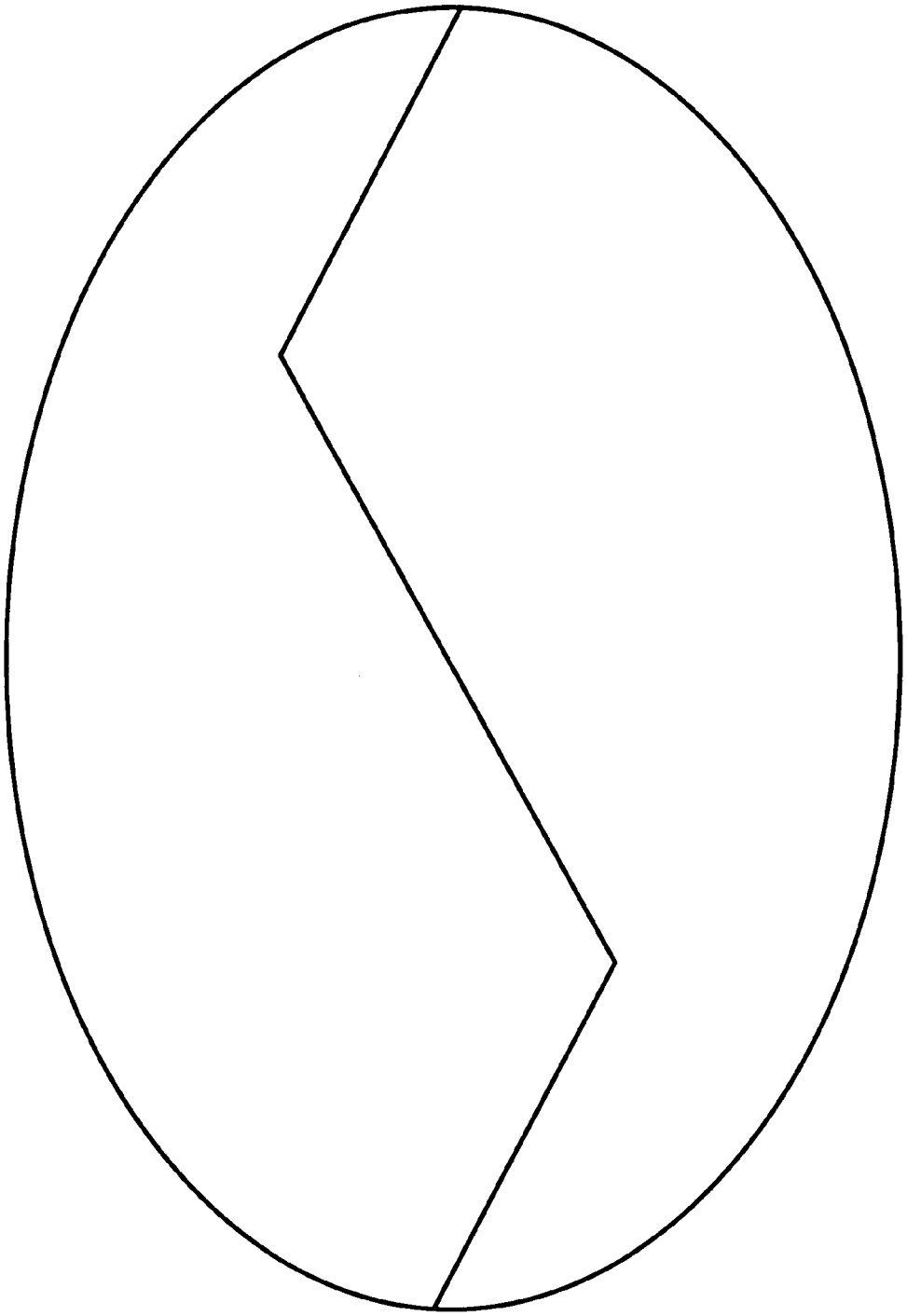
FIG. 10 is a top view of the dispensing wall of another embodiment of a dispenser in accordance with this invention. The opening is an "S" shape where the shape has sharp edges.
Figure 11:
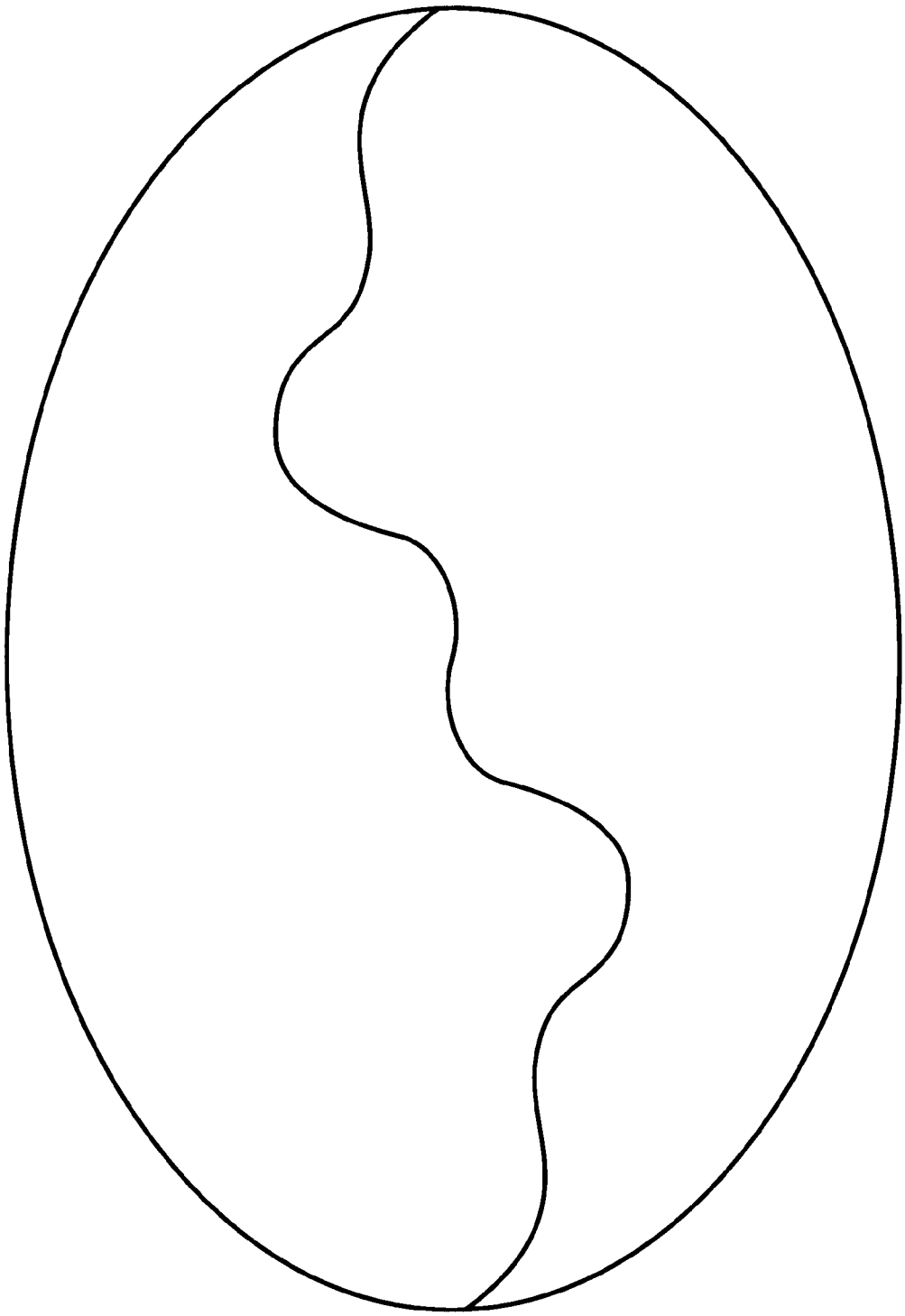
FIG. 11 is a top view of the dispensing wall of another embodiment of a dispenser in accordance with this invention. The opening is an irregular "S" shape with smooth curves.
Figure 12:
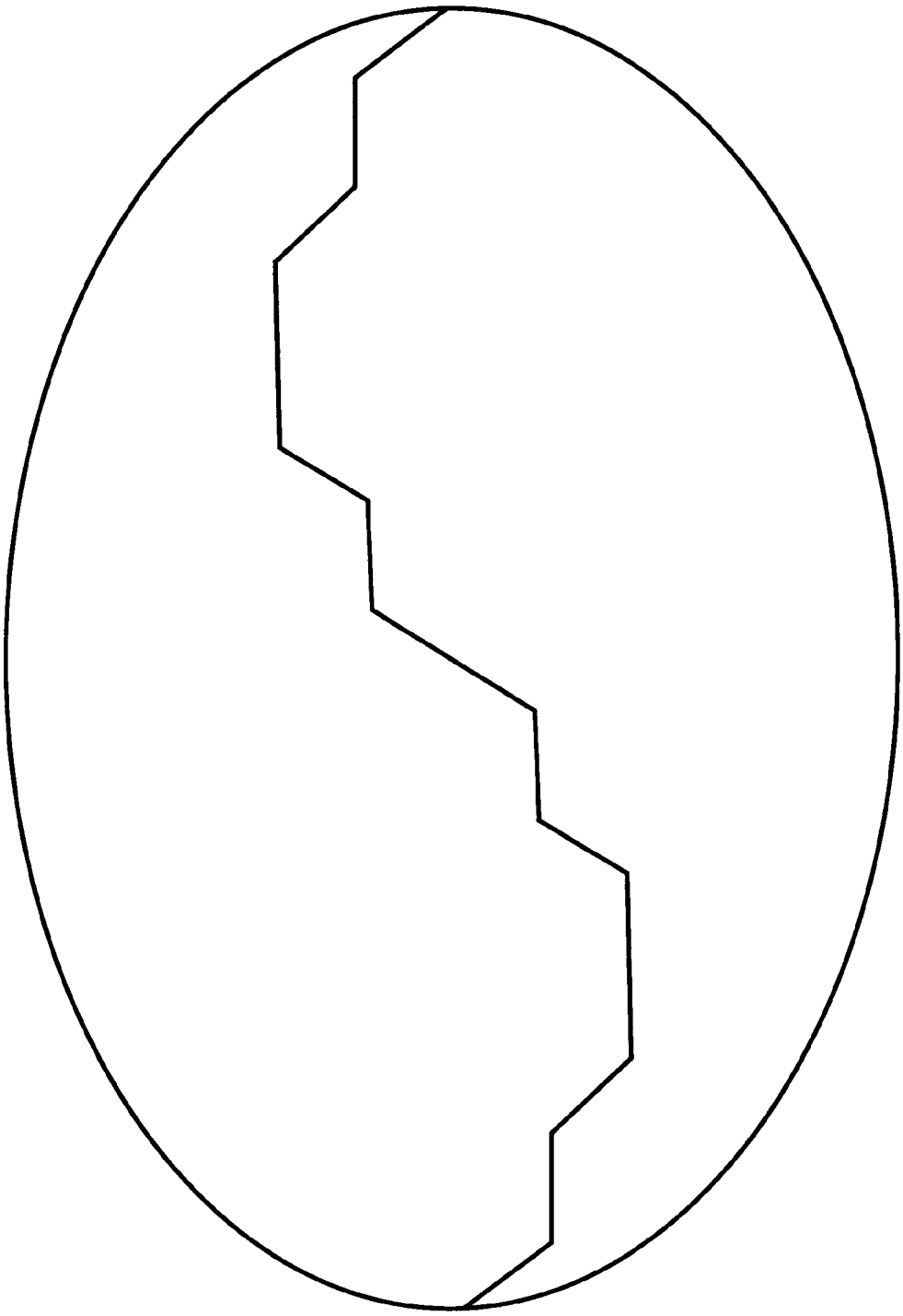
FIG. 12 is a top view of the dispensing wall of another embodiment of a dispenser in accordance with this invention. The opening is an irregular "S" shape with sharp edges.
Figure 13:
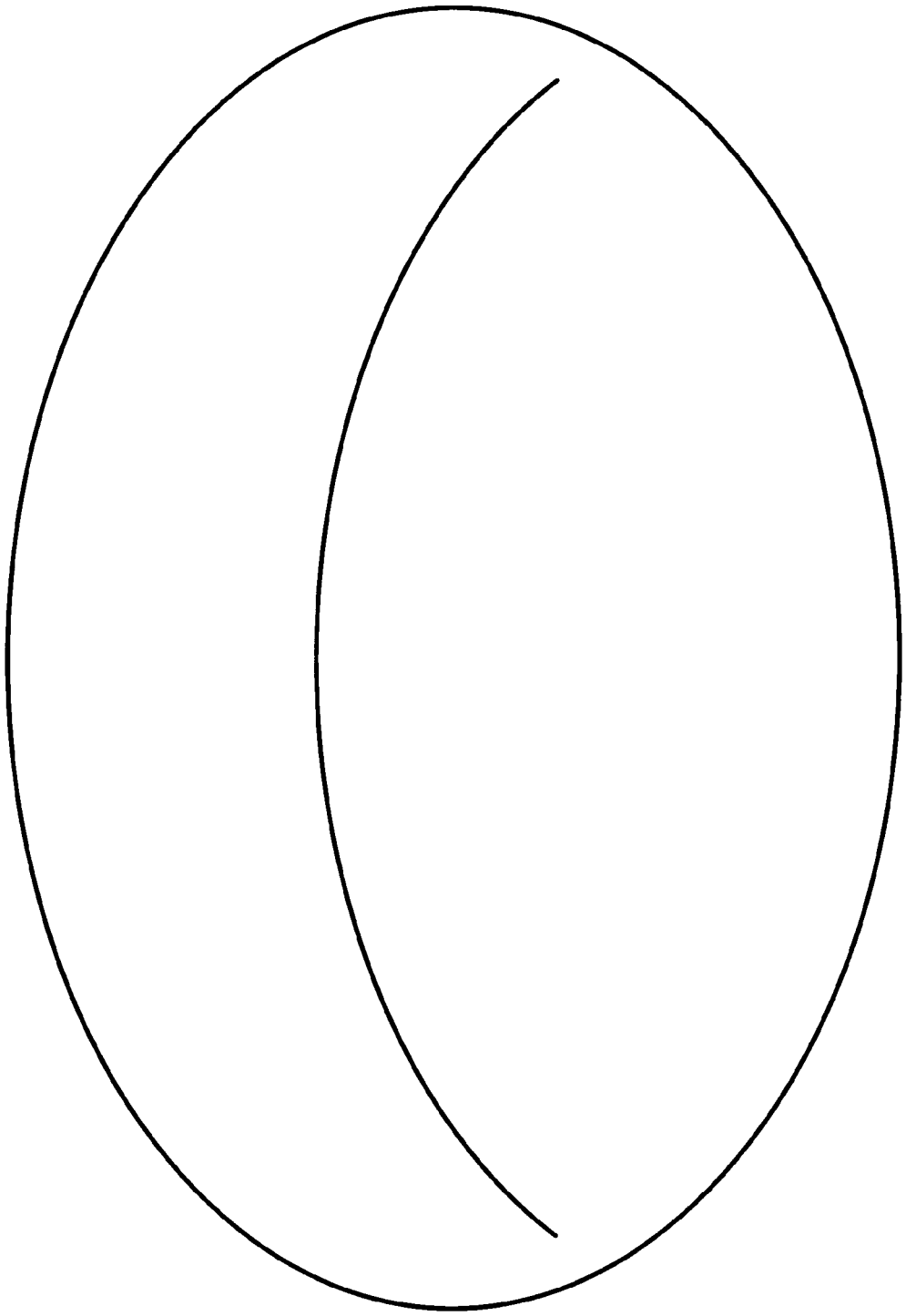
FIG. 13 is a top view of the dispensing wall of another embodiment of a dispenser in accordance with this invention. The opening is one arc of the "S" curve.
Figure 14:
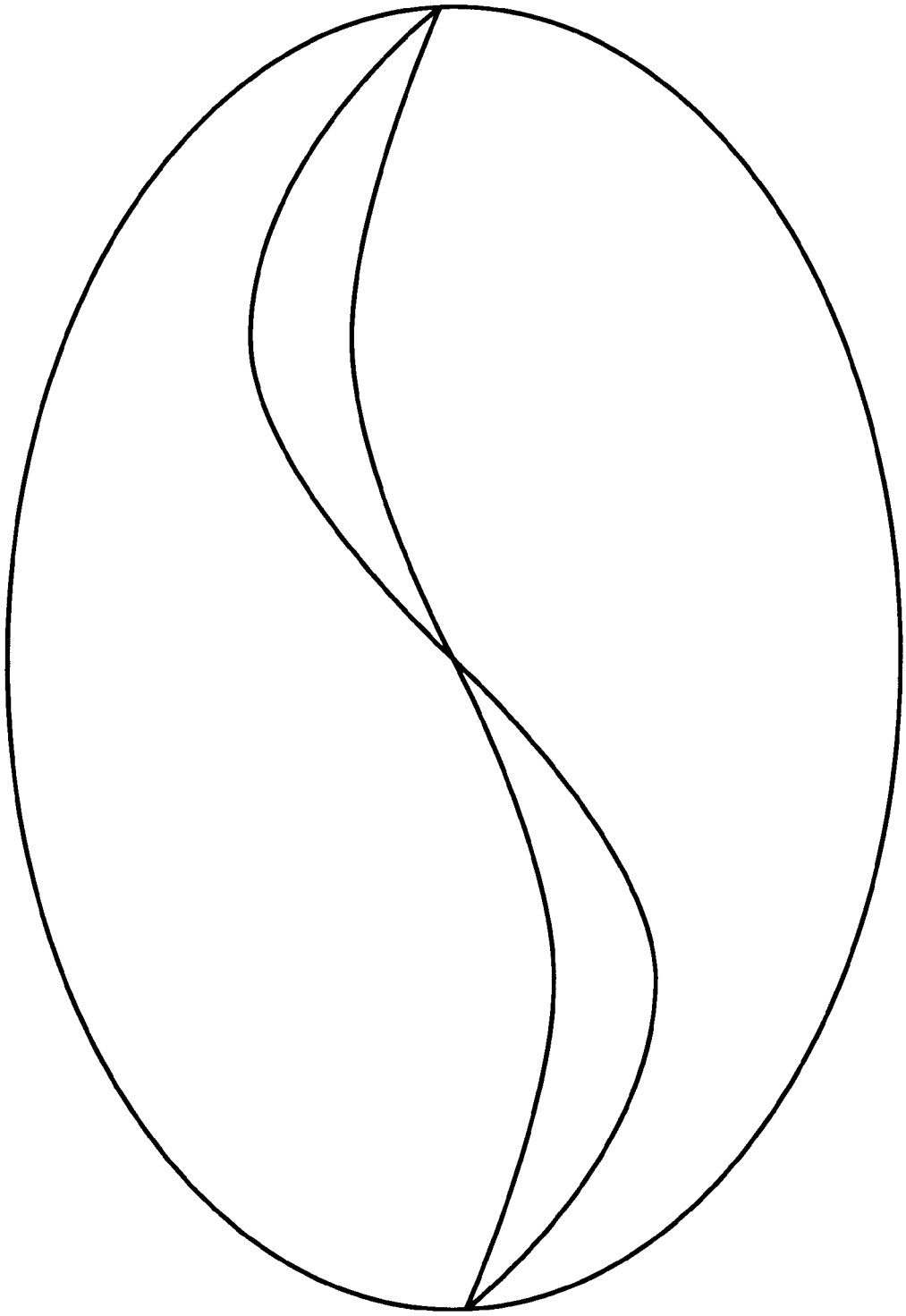
FIG. 14 is a top view of the dispensing wall of another embodiment of a dispenser in accordance with this invention. The opening is an "S" shape wherein the edges of the "S" are not in continuous contact throughout its entire length.

| | Single Slit Design (FIG. 1) | Medium "S" Design (FIG. 5) | Large "S" Design (FIG. 7) |
|---|---|---|---|
| Avg. No. of sheets torn at first access | 2 | 0.77 | 0.45 |
| Avg. No. of sheets tailing | 3.2 | 1.77 | 2.45 |

EXAMPLE 2

When a relatively strong tissue was used in the box, the tearing of the first sheet was minimal, but the effect of the different opening designs on tailing was significant. Table 2 shows the results of the second experiment using the strong tissue, but with all other conditions otherwise equivalent to the first experiment. The strong tissue sheet used in this experiment had a bulk of about 140/24 ply, a weight of about 21 lb./R., and a total tensile strength of about 23 oz./.in. A table summarizing the averages of the trial results is set forth below.

TABLE 2

Figure 2:
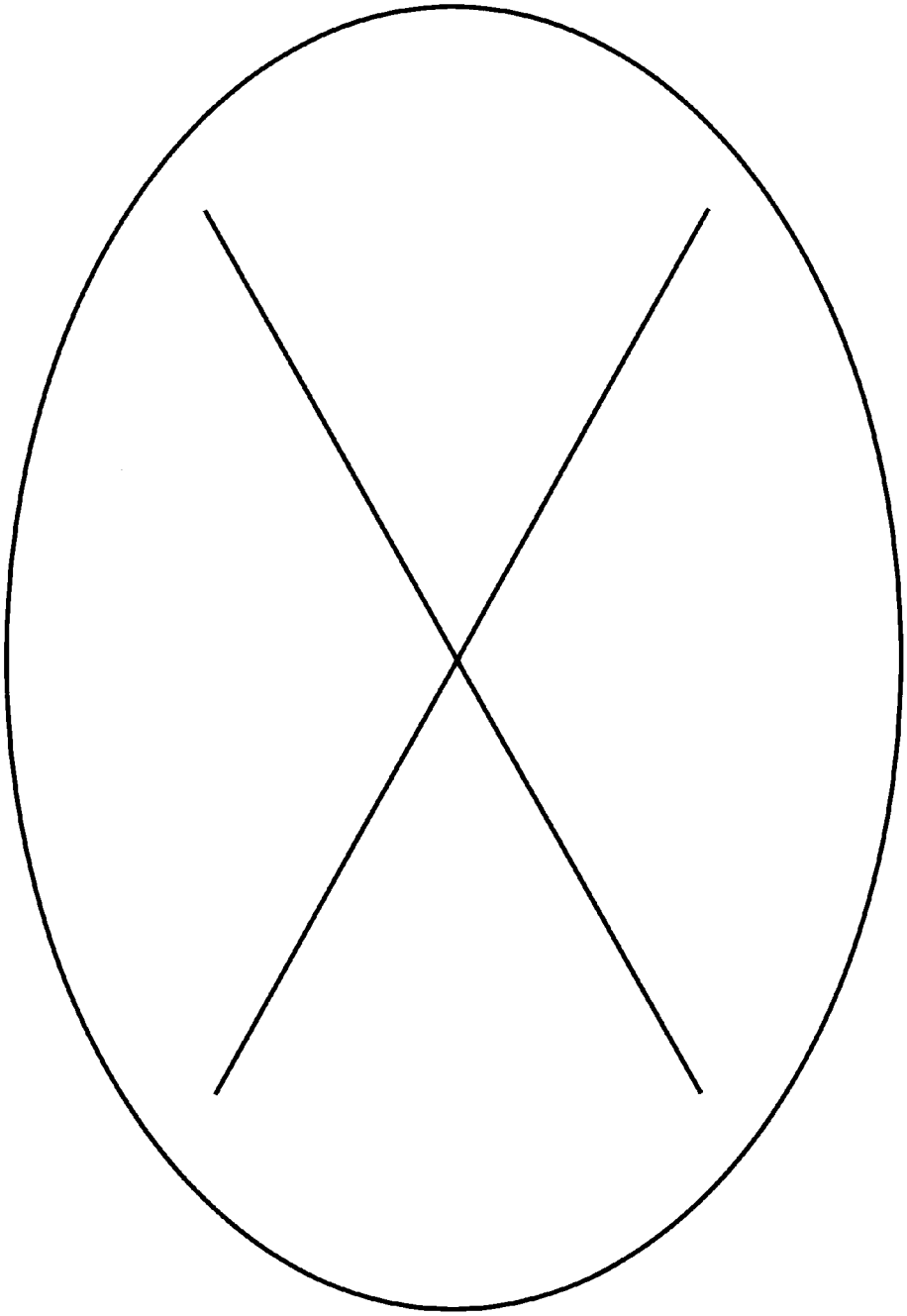
FIG. 2 PRIOR ART
FIG. 2 is a top view of the dispensing wall of another commercially available prior art tissue carton containing an X-shaped opening for an opening, as described in U.S. Pat. No. 5,415,320 of North et al.
Figure 3:
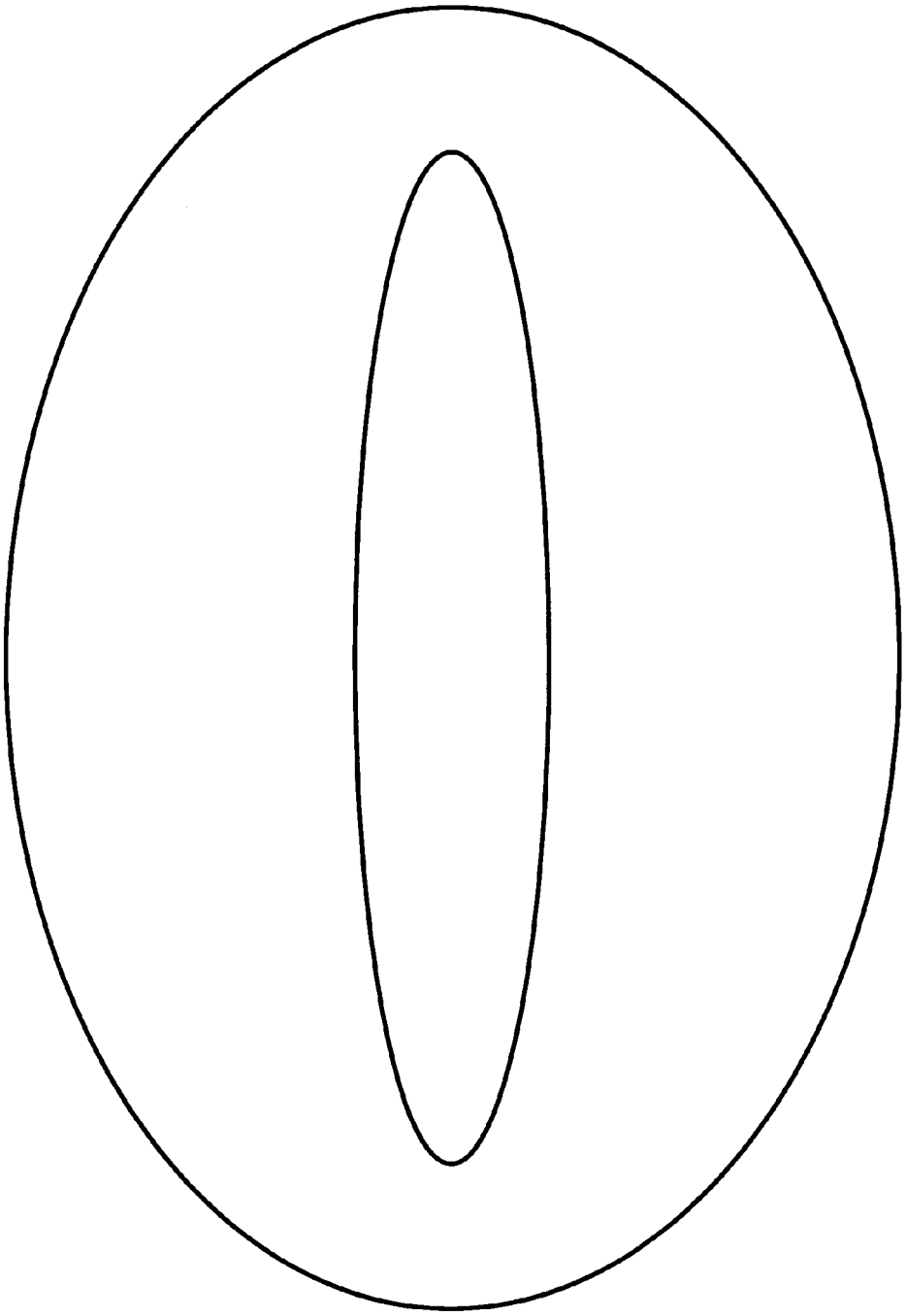
FIG. 3 PRIOR ART
FIG. 3 is a top view of the dispensing wall of another commercially available prior art tissue carton containing an oval-shaped opening for an opening, as described in U.S. Pat. No. 5,316,177 of Boldt.
Figure 4:
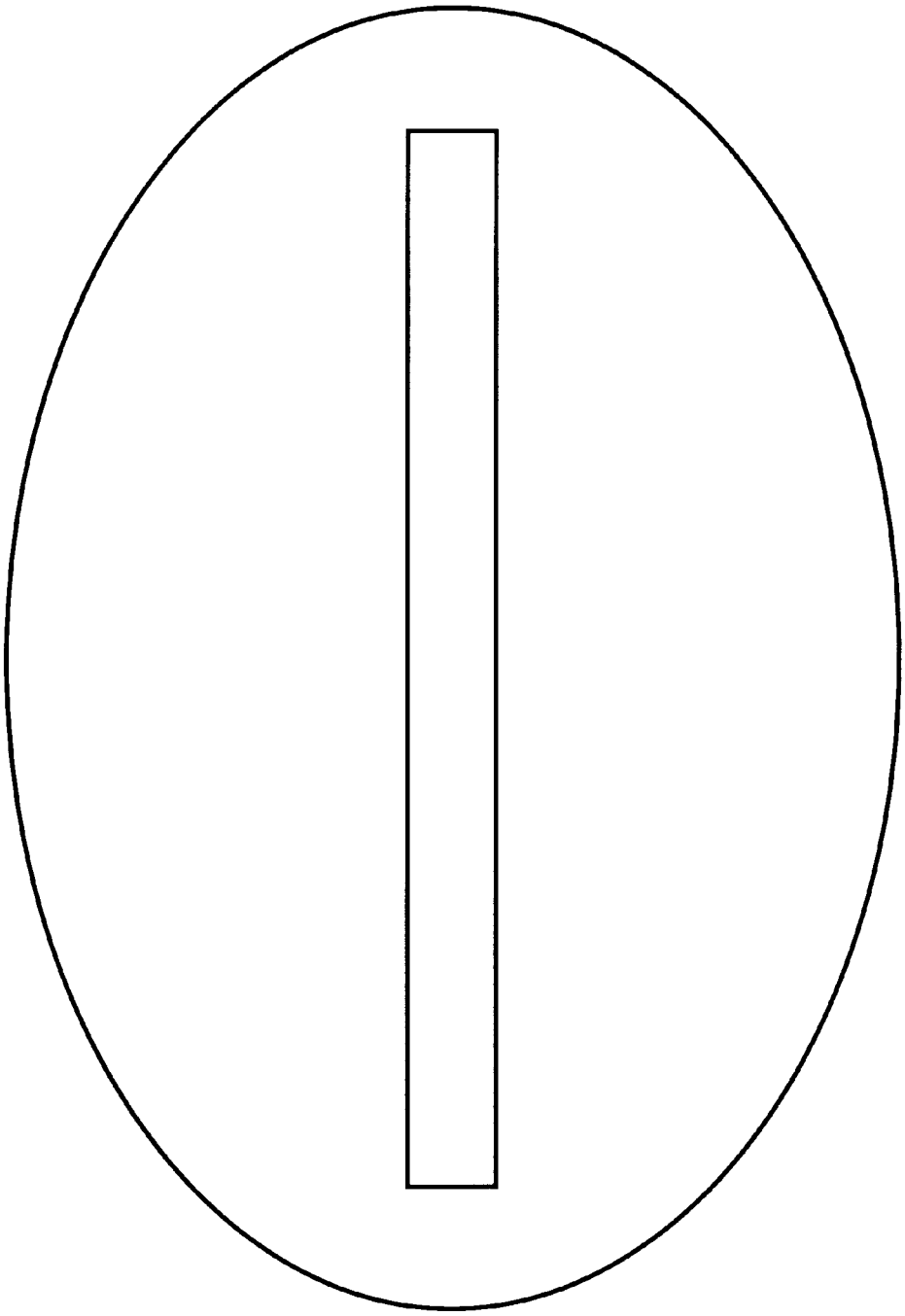
FIG. 4 PRIOR ART
FIG. 4 is a top view of the dispensing wall of another commercially available prior art tissue carton containing a rectangular opening for an opening, as described in U.S. Pat. No. 5,316,177 of Boldt.

| Opening Design | Avg. No. of Sheets Tailing |
|---|---|
| Single Slit (FIG. 1) | 3.20 |
| "X" Shape (FIG. 2) | 4.95 |
| Medium "S" Shape (FIG. 5) | 1.15 |
| Large "S" Shape (FIG. 7) | 1.85 |

While there have been described what are presently believed to be preferred embodiments of the invention, it will be apparent to one skilled in the art that numerous changes can be made in the ingredients, conditions and proportions set forth in the foregoing embodiments without departing from the invention as described herein and as defined in the appended claims.

What is claimed is:

1. An upright dispenser for the dispensing of thin sheets of a non-woven material, said dispenser comprising at least one tissue, a dispensing wall, at least three side walls and a bottom wall, said dispensing wall having a curvilinear opening through which the sheet may be withdrawn from the dispenser and the dispensing opening comprises a plurality of irregularly-shaped "S"-shaped curves.

2. An upright dispenser for the dispensing of thin sheets of a non-woven material, said dispenser comprising at least one tissue, a dispensing wall, at least three side wells and a bottom wall, said dispensing wall having a curvilinear opening through which the sheet may be withdrawn from the dispenser and the dispensing opening comprises at least two line segments joined at an angle of less than 175 degrees.

3. An upright dispenser for the dispensing of interfolded paper tissue sheets, said dispenser comprising tissues, a dispensing wall, at least three side walls and a bottom wall, said dispensing wall having a curvilinear slit through which the sheets may be withdrawn from the dispenser and an effective open area of less than about 2.5 square inches.

* * * * *